US009637206B2

(12) United States Patent
Ganguli et al.

(10) Patent No.: US 9,637,206 B2
(45) Date of Patent: May 2, 2017

(54) ADAPTER FOR THE INSERT OF TWO-TABBED FINS INTO SINGLE-TABBED FIN BOXES OF A SURFBOARD

(71) Applicants: Julian Ganguli, Carlsbad, CA (US); David Enrique Aguilo, Encinitas, CA (US)

(72) Inventors: Julian Ganguli, Carlsbad, CA (US); David Enrique Aguilo, Encinitas, CA (US)

( * ) Notice: Subject to any disclaimer, the term of this patent is extended or adjusted under 35 U.S.C. 154(b) by 121 days.

(21) Appl. No.: 14/567,013

(22) Filed: Dec. 11, 2014

(65) Prior Publication Data

US 2015/0166152 A1 Jun. 18, 2015

Related U.S. Application Data

(60) Provisional application No. 61/916,106, filed on Dec. 13, 2013.

(51) Int. Cl.
*B63B 35/00* (2006.01)
*B63B 35/79* (2006.01)

(52) U.S. Cl.
CPC ..... *B63B 35/793* (2013.01)

(58) Field of Classification Search
CPC ..... B63B 35/793
USPC ..... 441/79; D21/771
See application file for complete search history.

(56) References Cited

U.S. PATENT DOCUMENTS 3,422,471 A * 1/1969 Pope ..... B63B 35/793 114/126
3,516,099 A 6/1970 Morey
3,585,663 A 6/1971 Johnson
4,379,703 A * 4/1983 Mizell ..... B63B 35/793 441/79
5,464,359 A * 11/1995 Whitty ..... B63B 35/7926 403/263
5,493,989 A 2/1996 Anderson
5,672,081 A 9/1997 Whitty
(Continued)

FOREIGN PATENT DOCUMENTS

AU 669096 B3 9/1995
EP 0834451 A2 4/1998
(Continued)

OTHER PUBLICATIONS

Stand Up Power Gower: "Changing Your Fins=Performance"; http://www.supgower.com/2011/03/changing-your-fins-performance/.*

(Continued)

*Primary Examiner* — Joshua Kennedy

(74) *Attorney, Agent, or Firm* — Eric A. Hanscom; Todd J. Langford

(57) ABSTRACT

A removable surfboard fin adapter that allows removable fins, fin boxes and fin systems from different manufacturers to be compatible with each other. A two-tabbed type removable surfboard fin is received and secured in the recess of a single-tab type surfboard fin receiving box that would not otherwise be able to receive and secure a two-tabbed type removable surfboard fin. The adapter includes two slots that accept the tabs of the two-tabbed fin. The front, rear, or both front and rear of the adapter include a notch for securing he adapter to the single-tab receiving box. Angled slots are provided for canted fins.

27 Claims, 5 Drawing Sheets

(56) References Cited

U.S. PATENT DOCUMENTS

| | | | | |
|---|---|---|---|---|
| 5,830,025 | A * | 11/1998 | Fleming | B63B 35/7926 114/140 |
| 5,975,974 | A | 11/1999 | McCausland | |
| 5,997,376 | A | 12/1999 | Block | |
| 6,139,383 | A | 10/2000 | Jolly | |
| 6,595,817 | B1 * | 7/2003 | Chang | B63B 35/793 441/74 |
| 6,752,674 | B2 | 6/2004 | Jolly | |
| 7,198,532 | B2 * | 4/2007 | Field | B63B 35/793 114/127 |
| 7,285,031 | B2 | 10/2007 | Mair | |
| 7,497,752 | B2 * | 3/2009 | Field | B63B 35/793 114/127 |
| 8,469,757 | B2 * | 6/2013 | Luke | B63B 35/7926 441/79 |
| 8,764,502 | B2 | 7/2014 | McCredie | |
| 8,808,043 | B2 | 8/2014 | Bradley | |
| 8,845,374 | B2 * | 9/2014 | Higgins | B63B 35/793 441/79 |
| D755,320 | S * | 5/2016 | Aguilo | D21/771 |
| 2007/0202760 | A1 * | 8/2007 | Caldwell | B63B 35/793 441/79 |
| 2013/0178123 | A1 | 7/2013 | Ivory | |
| 2013/0189886 | A1 | 7/2013 | Yeh | |
| 2015/0239532 | A1 * | 8/2015 | Wood | B63B 35/793 441/79 |
| 2016/0234218 | A1 * | 8/2016 | Liu | H04W 4/02 |
| 2017/0001693 | A1 * | 1/2017 | Elliott | B63B 35/793 |

FOREIGN PATENT DOCUMENTS

| | | | |
|---|---|---|---|
| WO | WO-2006021029 | A1 | 3/2006 |
| WO | WO-2009023933 | A2 | 2/2009 |

OTHER PUBLICATIONS

FCS Longboard Box Adapter, http://www.amazon.com/.
GripIt, http://store.magicseaweed.com/.
NSP Adapter, http://store.magicseaweed.com/.

* cited by examiner

ADAPTER FOR THE INSERT OF TWO-TABBED FINS INTO SINGLE-TABBED FIN BOXES OF A SURFBOARD

CROSS-REFERENCE TO RELATED APPLICATIONS

This patent application claims the benefit of an earlier provisional patent filing dated Dec. 13, 2013 with patent Ser. No. 61/916,106 and having the same inventorship.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the field of fins attached to the underside of watercrafts. More particularly, the present invention is in the field of removable surfboard fins. Specifically, the present invention gives a surfer the ability to securely fasten a two-tabbed removable fin to a single-tab fin box, which would otherwise not be possible.

The ability to change the fins on a surfboard has various advantages for the owner of a surfboard. Many surfboard owners experiment with different removable surfboard fin designs and materials to find a fin configuration that best suits their surfing style, surfboard performance and ocean conditions.

Surfboards, Stand-Up Paddleboards and Kayaks typically have either 1 large fin or 3 small fins and less frequently 2, 4 or 5 fins. In the case of 1-fin surfboard, the fin is usually fixed on the underside of the board towards its tail along the centerline. A 3-fin surfboard usually includes a fin attached to the underside of the rear of the board on its centerline, and 2 other side fins placed symmetrically towards the outside edges of the board, which are canted outward.

Different fin arrangements change the performance of the surfboard. Typically, a 1-fin arrangement improves the speed of a surfboard. A 2-fin arrangement improves the maneuverability of a surfboard. A 3-fin arrangement is the most common and gives the board a mix of characteristics from a 1-fin and 2-fin arrangement. However, the 3-fin arrangement increases drag and can make a surfboard slower in the water. A 4-fin arrangement has two outer fins on the left and right side of a surfboard but no center fin. A 4-fin arrangement has similar properties to that of a 2-fin arrangement but it lacks control when compared to a 1-fin or 3-fin arrangement. A 5-fin arrangement has a similar arrangement to that of a 4-fin arrangement and also includes a center fin (typically smaller). A 5-fin arrangement has similar properties to that of 3-fin arrangement in terms of controllability but is typically faster like a 4-fin arrangement.

In some cases, surfboard fins are fixed to a surfboard permanently using various materials that typically include resins and fiberglass. In other cases, surfboard fins are temporarily fixed to surfboards by means of removable fin systems. As mentioned previously, the ability to change fins with a removable fin system has numerous advantages when compared to a surfboard with a permanently fixed fin or fins to the underside of the surfboard. When traveling with one or more surfboards, the ability to remove fins from a surfboard enables the surfer to reduce the space needed to pack the surfboard, saving the area that would otherwise be needed for the clearance of the fin or fins. Also, when traveling with one or more surfboards, it is common for the surfboard to be handled by airline, train, or bus staff. In many cases, surfboards get damaged during the handling process. A common area of damage to a surfboard during this process is the breakage of fixed fins on the surfboard. By removing the one or more removable fins, a surfer greatly reduces the risk of damage to the surfboard, prolonging the life and usefulness of the surfboard.

Another advantage to surfboard owners is having the ability to change out the removable fins on a surfboard with a removable fin system to improve surfboard performance. It is common practice for surfers to change their removable fins depending on the wave conditions, surfboard shape, and desire for experimentation, all of which can lead to performance improvements. Having a surfboard with a removable fin system allows a surfer to use fins with different base lengths, foils, rake, heights, materials, and other design elements. These are some of the many advantages that explain why a majority of surfboards today are manufactured with removable fin systems compared to a surfboards manufactured with a fixed fin or fins.

Several removable fin systems currently exist, which removably secure removable fins to fin boxes or fin plugs embedded in the underside of a surfboard. Examples of existing removable fin systems include U.S. Pat. Nos. 5,830,025, 5,464,359, and 5,975,974. The receiving component of the removable fin systems, commonly known as fin boxes or fin plugs, are usually embedded into the underside of a surfboard during the surfboard manufacturing process. Generally a fin box or fin plugs consist of one or two slots which allow the receiving and securing of single-tabbed and two-tabbed removable fins respectively. There are many fin systems available that use various methods to retain a removable fin in the fin box or fin plug. Some fin systems allow fins to snap into the fin boxes or fin plugs while others require tools for installation and removal of a fin from its fin box or plugs. Many of these fin systems are designed to only accept removable fins of their corresponding unique design. More specifically, the unique fin attachment methods of the most systems do not allow removable fins from other incompatible systems to be securely fastened. This is a disadvantage for surfboard owners with these types of removable fin systems because as many surfboard owners desire to experiment with varying fin designs, shapes, and materials from systems other than the system embedded in their surfboard they are typically restricted to solely using fins originally designed to be accepted by the type of system in their boards. It is possible to remove the existing fin boxes or fin plugs from a surfboard by routing-out the existing fin boxes or fin plugs and embedding new fin boxes or plugs into the surfboard using resins and fiberglass. However, surfers rarely use this practice because it negatively impacts the overall structural integrity of the surfboard, which can decrease performance and increase the risk of surfboard or fin system failure and or breakage. The practice of replacing the original fin system on a surfboard can also add weight to the surfboard because of the added materials needed to embed the new fin system into the routed cavities. Not only are surfers sensitive to any increases in weight of their surfboards but also to the distribution of weight or "balance" of a surfboard. This fin re-routing and re-embedding method both adds weight and changes the optimal weight distribution or "balance" of a surfboard. The fin, fin system and fin accessory market is estimated to be at least $100 million annually and growing. This trend suggests that a mature market exists for related surf accessory products.

Prior art for fin adapters currently exist for limited number of removable fin systems. Examples of prior art include the 2005 U.S. Pat. Application 2007/0202760, U.S. Pat. Nos. 7,497,752, and 7,285,031. In the mentioned prior art, the removable fin is attached to the adapter by angled set-screws which are threaded into the from the side of the removable fin system embedded in the water craft. This is a limiting factor and disadvantage because this prior art cannot be used with removable fin systems that use one angled set-screw positioned on the front part the removable fin system embedded on the under side of the surfboard.

At the time of this writing, research suggests that, over 90% of surfboards are manufactured with one of two removable fin systems shown in U.S. Pat. Nos. 5,830,025 and 5,464,359. U.S. Pat. No. 5,830,025 uses one set-screw positioned at the front part of the removable fin system embedded on the underside of the surfboard to secure a single-tabbed fin to said removable fin system. U.S. Pat. No. 5,464,359 uses two fin plugs that each contain one set-screw positioned on the side of the respective fin plug used to secure a two-tabbed removable fin to the underside of the surfboard. As mentioned earlier, sales for compatible removable fins and accessories are estimated to be $100 million industry and growing, reaffirming the demand for removable fins of these two removable fin systems. It is common for a surfboard owner to own multiple surfboards, which each contain one of these two removable fin systems. It is a disadvantage for the surfboard owner in situations like this because the surfboard owner must purchase multiple sets of fins for each respective removable fin system and bring multiple sets of fins for each removable fin system when traveling.

The present invention distinguishes over this art with an inventive attachment method that allows for a removable two-tabbed fin to be adapted using the present invention for compatibility with a removable fin system that uses one set-screw located on the front portion of the receiving fin box as in U.S. Pat. No. 5,830,025, which would otherwise not be possible.

The advantages of the present invention include, without limitation, the ability to securely fasten a two-tabbed removable fin to a single-tab fin box, which would otherwise not be possible.

In broad embodiment, the present invention is a removable surfboard fin adapter that enables removable fins, fin boxes and fin systems from different manufacturers to be compatible. Again, the surfing accessory market is major source of revenue for the growing $1 billion surf industry.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed in the United States of America or elsewhere before the priority date of each claim of this application.

SUMMARY OF THE INVENTION

The present invention is a device used to enable a two-tabbed type removable surfboard fin to be received and secured in the recess of a single-tab type surfboard fin receiving box that, without said device, would not be able to receive and secure a two-tabbed type removable surfboard fin.

DETAILED DESCRIPTION OF THE INVENTION

FIG. 1

Figure 1:
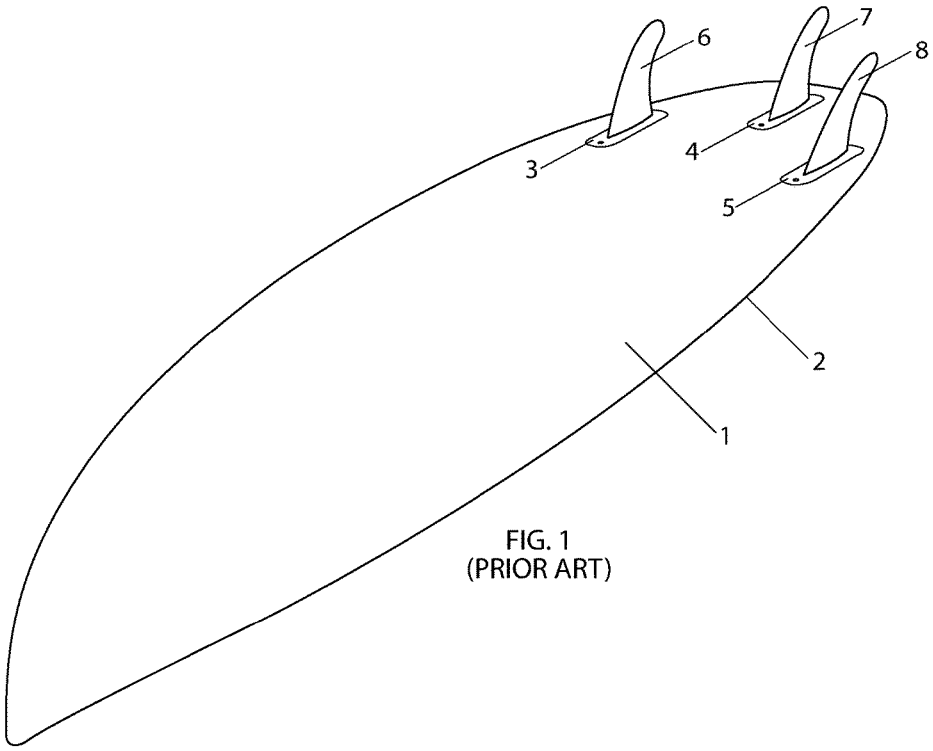
FIG. 1 (PRIOR ART)
FIG. 1 is a perspective view of a the underside of a typical surfboard with a three fin arrangement and the embedded surfboard fin receiving boxes or plugs.

FIG. 1 shows the underside 1 of a surfboard 2 with a typical three-fin arrangement at the rear of the surfboard. Also shown are the fin retaining structures 3, 4, and 5 which are embedded into the underside of the surfboard 1 and receive the removable surfboard fins 6, 7 and 8 and secure them to the surfboard 2. More specifically, fin box 4 secures the center fin 7, while fin boxes 3 and 5 secure the right outside fin 6 and left outside fin 8 respectively (the 'left side of surfboard' referring to the 'left' side when looking at the underside of the surfboard from the rear, where the fins are located, towards the front).

FIG. 2

Figure 2:
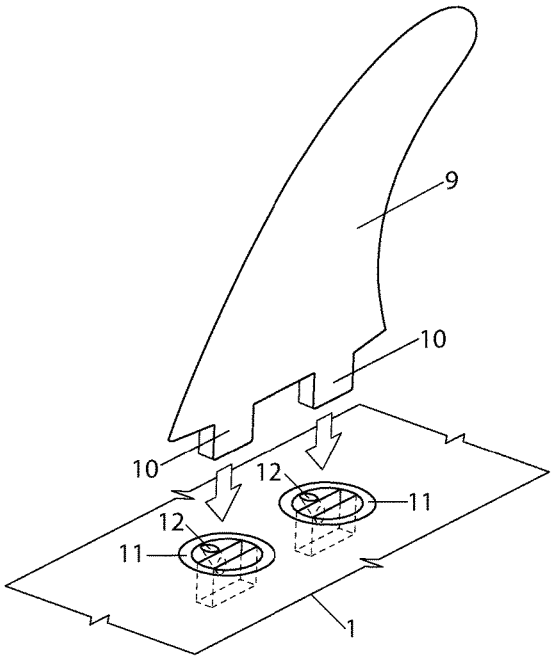
FIG. 2 (PRIOR ART)
FIG. 2 shows an axonometric view of a typical removable two-tabbed fin system consisting of a removable two-tabbed fin and its corresponding receiving plugs which are embedded in the underside of a surfboard.

Shown in FIG. 2 is an existing two-tabbed removable surfboard fin system comprised of a two-tabbed removable surfboard fin 9 and its respective two tabs 10 as well as the two-tabbed fin receiving plugs 11 which are embedded into the underside of a surfboard 1. Furthermore, also shown are the threaded holes 12 which receive set-screws that secure the two-tabbed fin 9 by engaging its two tabs 10 once inserted into the two-tabbed fin receiving plugs 11. Typically an Allen Wrench is used to thread the set-screws into the threaded holes 12 of the fin plugs 11. Note that the two-tabbed removable surfboard fin 9 may have tabs of different geometry than what is shown.

FIG. 3

Figure 3:
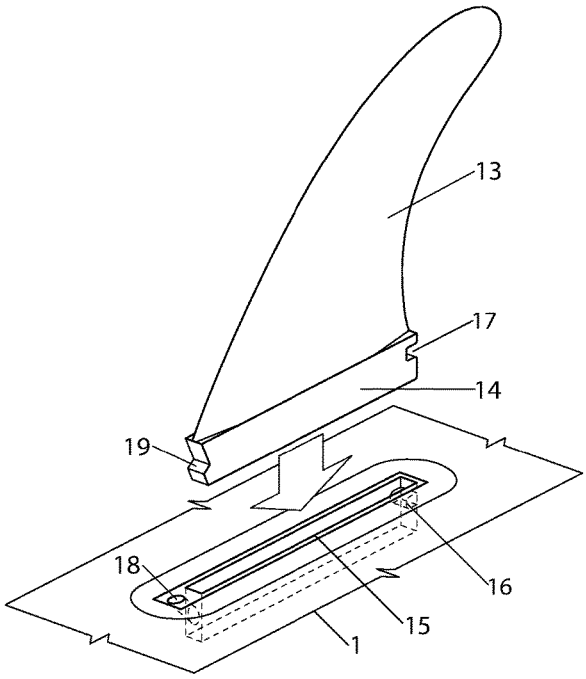
FIG. 3 (PRIOR ART)
FIG. 3 shows an axonometric view of a typical removable single-tab fin system consisting of a removable single-tab fin and its corresponding receiving fin box which is embedded in the underside of a surfboard.

Shown in FIG. 3 is an existing single-tab removable surfboard fin system comprised of a single-tab removable surfboard fin 13 and its respective single-tab 14 as well as the single-tab fin receiving box 15 which is embedded into the underside of a surfboard 1. Furthermore, also shown is the single-tab fin receiving box 15 and its retention member 16, which engages the rear notch 17 of the single-tab surfboard fin tab 14. Also shown, is the threaded hole 18, which receives a set-screw that secures the single-tab removable surfboard fin 13 to the single-tab fin receiving box 15 by engaging the front notch 19 of single-tab surfboard fin tab 14. Typically an Allen Wrench is used to thread the set-screw into the threaded hole 18 of the fin box 15.

FIG. 4

Figure 4:
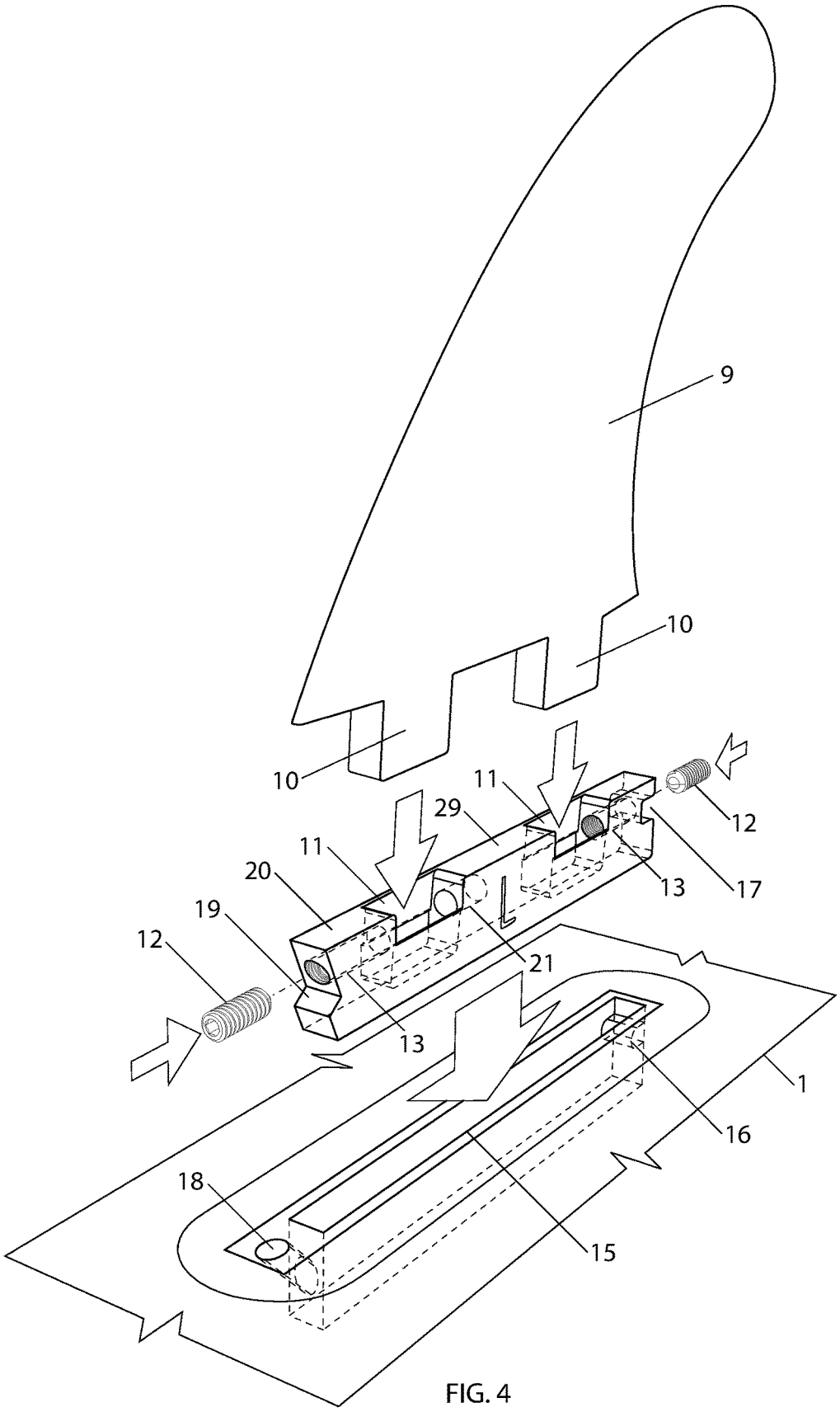
FIG. 4 is a perspective view of the present invention illustrating the method for using the present invention for inserting and securing a two-tabbed surfboard fin into a single-tab fin box.

Shown in FIG. 4, in perspective view, is a preferred embodiment of the invention, generally referenced as 20, and how it allows a left side two-tabbed fin 9 to be received and secured by a left side single-tabbed fin box 15 in the left side of a surfboard. More specifically, the two tabs 10 of the left side two-tabbed fin 9 are received by the angled vertical slots 11, separated by a spacer 29 that is slightly smaller than a space between two tabs 10 of a two-tabbed fin 9, and secured to the present invention 20 by the set-screws 12, which engage the lateral holes 13 at the front and rear ends of the present invention 20. Once the two-tab fin 9 is inserted into and secured by the present invention 20, that assembly is inserted into and secured to the underside of surfboard 1 by the embedded single-tab type surfboard fin box 15. More specifically, the coupled two-tab fin 9 and the present invention 20 assembly is secured to the single-tab surfboard fin box 15 by means of the rear notch 17 of the present invention 20 engaging the retention member 16 of the single-tab type surfboard fin box 15 and the front notch 19 of the present invention 20, being engaged by a set-screw received by the threaded hole 18 of the single-tab type surfboard fin box 15. Also shown is the pullout hole 21 used to retrieve the present invention 20 from the single-tab surfboard fin box 15 in case the single-tab fin 9 becomes decoupled from the present invention 20 for any reason. Typically an Allen Wrench is used to thread the set-screws 12 into the threaded holes 13 of the present invention 20.

In further detail, still referring to the present invention 20 in FIG. 4, one embodiment of the invention has the angled vertical slots 11 sufficiently wide and deep to enable a close-fitting for each fin tab 10, approximately 0.8 inches in length by 0.25 inches in width by 0.55 inches in depth. Set-screws 12 are sufficient in length such that when set-screws 12 are screwed into the present invention 20, the set-screws 12 do not protrude beyond the exterior surface walls of the present invention. The pull-out hole 21 is a cylindrical hole approximately 0.16 inches in diameter and 0.375 inches in depth to enable a secondary release function in the event an existing two-tab fin 9 is inadvertently ejected allowing for easy removal from the present invention 20 from the existing single-tabbed fin box 15.

In further detail still referring to FIG. 4, when an existing two-tab fin 9 has tabs 10 of different geometry than what is shown in FIG. 4, the present invention would correspondingly have geometry that would allow a close-fit tongue and groove connection between the two fin tabs and the vertical slot or slots of the present invention, those vertical slots being either angled or straight.

FIG. 5

Figure 5:
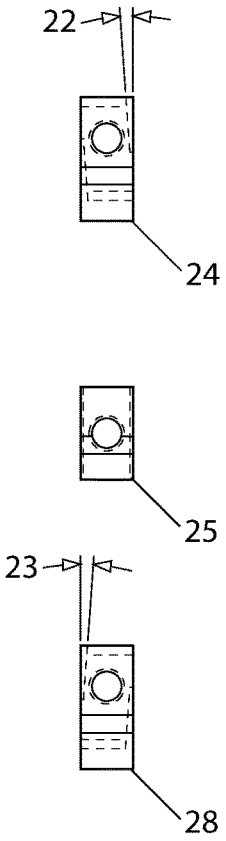
FIG. 5 is a front elevation view of several preferred embodiments of the present invention, the left, center and right embodiments.

FIG. 5 shows several preferred embodiments of the present invention, right, center and left 24, 25 and 28 respectively, in front elevation view. In a typical three-fin arrangement the center fin is upright or perpendicular to the underside of the surfboard while the side fins are slightly canted outward towards the surfboards side rails since increasing the fins' cant leads to a more responsive board through turns, while decreasing the cant (bringing it closer to a 90° angle relative to the bottom of the board) makes the board faster, especially when traveling in a straight line. Therefore, also shown is the angled nature of the vertical slots of the right and left embodiments of the present invention 24 and 28, relative to the present invention's vertical sidewalls as well as the non-angled nature of the vertical slots of the center embodiment of the present invention 25. In further detail shown using dimension lines and arrows are the angles 22 and 23 of the angled vertical slots of the right and left embodiments of the present invention 24 and 28 respectively.

FIG. 6

Figure 6:
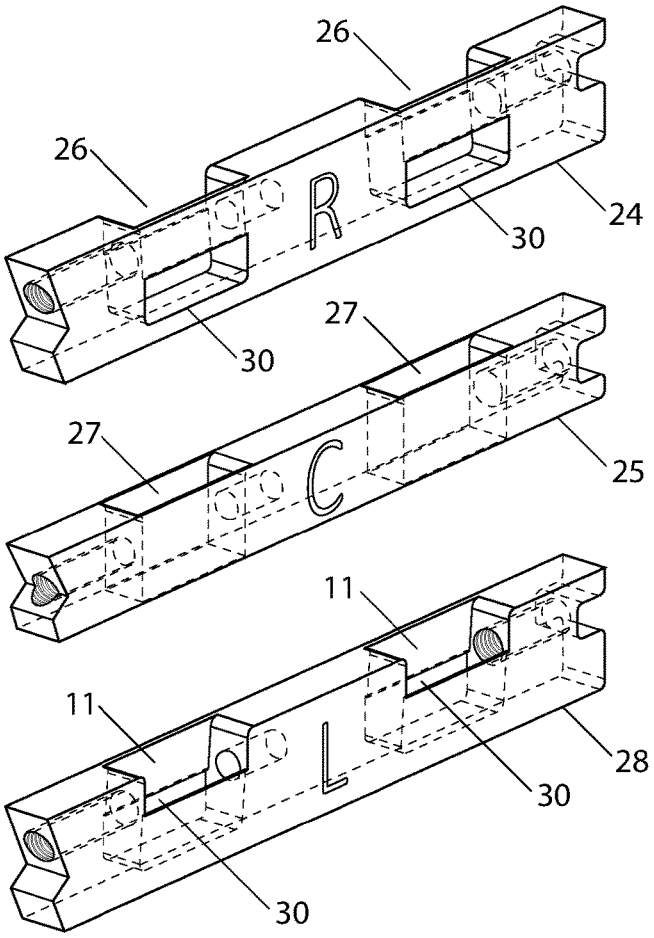
FIG. 6 is an axonometric view of several preferred embodiments of the present invention, the left, center and right embodiments, shown as the top, center, and bottom image respectively.

FIG. 6 shows the preferred embodiment of the present invention in its right, center and left-side embodiments 24, 25 and 28 respectively in axonometric view. The embodiment's left and right side versions of the present invention 24 and 28 incorporate angled vertical slots 26 and 11, relative to the present invention's vertical side walls, to retain the side fins at corresponding canted angles, approximately between 0 to 8 degrees relative to the vertical side walls of the present invention. The embodiments left and right side versions of the present invention 24 and 28 respectively, include one or more side wall cut-outs 30 of a rectangular shape to maximize canted angles of the fins received and secured. The center embodiment of the present invention 25 has non-canted vertical slots 27, relative to its vertical side walls. The center embodiment of the present invention 25 is shallower in height than the right and left embodiments of the present invention 24 and 28 to account for a shallower recess in its corresponding center single-tab surfboard fin box. The center single-tab surfboard fin box is shallower than the side fin boxes due to the center fin box being place further towards the rear of the surfboard where the thickness of the board is reduced.

In further detail, still referring to FIG. 6, one embodiment of the present invention calls for the version to fit within a standard single-tabbed fin box. A preferred embodiment of the left and right versions of the present invention 24 and 28, are sufficiently long, wide and deep to enable a close fit into their corresponding existing right and left single-tab fin boxes, approximately 4½ inches in length by ⅓ inches in width by ⅔ inches in depth, and particularly preferred embodiment calls for approximately 4.460 inches in length by 0.28 inches in width by 0.67 inches in depth.

Similarly, one embodiment of the present invention 25 calls for the version to fit within standard single-tabbed fin box. A preferred embodiment of the present invention 25 is sufficiently long, wide and deep to enable a close fit into its corresponding existing center single-tab fin box, approximately 4½ inches in length by ⅓ inches in width by ½ inches in depth, particularly the preferred embodiment calls for approximately 4.445 inches in length by 0.28 inches in width by 0.5 inches in depth. The preferred embodiment of the present invention has a tight fit between the fin tabs and fin boxes but an alternate embodiment could have a looser fit allowing the fin's canted angle to fluctuate.

The construction details of the invention as shown in FIG. 6 are that the preferred right, center and left embodiments of the present invention 24, 25 and 28 could be made of sufficiently strong plastics and/or metals while alternate embodiments could be made out of plastics, metals, resins, resin/fiberglass, wood, carbon fiber, graphite, composites or any other known means commonly in use in the surfboard manufacturing industry.

FIG. 7

Figure 7:
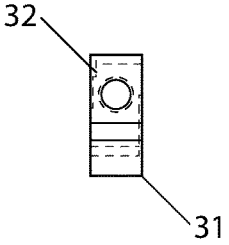
FIG. 7 is a front elevation view of an alternative embodiment for the left and right surf fin adapter. The right embodiment is simply a mirrored embodiment of the left embodiment. For this reason, FIG. 7 only includes the left view of the alternative embodiment.

FIG. 7 shows another embodiment of the invention 31 in front elevation view. In more detail, the other embodiment of the invention 31 shown is the left embodiment, where the right embodiment is a mirrored embodiment of the left embodiment and is not shown in FIG. 7. This embodiment of the invention includes an alternative way to achieve canted angles using a folded tab and stepped vertical slot 32. Other aspects of this other embodiment 31 are similarly described in FIG. 5.

FIG. 8

Figure 8:
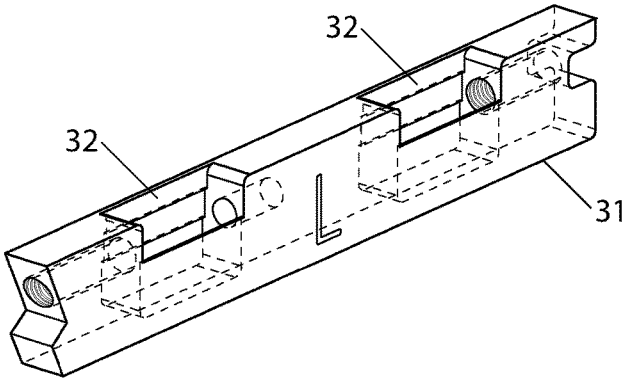
FIG. 8 is an axonometric view of an alternative embodiment for the left and right surf fin adapter. The right embodiment is simply a mirrored embodiment of the left embodiment. For this reason, the FIG. 8 only includes the left view of the alternative embodiment.

FIG. 8 shows another embodiment of the invention 31 in axonometric view. In more detail, the other embodiment of the invention 31 shown is the left embodiment, where the right embodiment is a mirrored embodiment of the left embodiment and is not shown in FIG. 8. This embodiment of the invention includes an alternative way to achieve canted angles using a folded tab and stepped vertical slot 32. Other aspects of this other embodiment 31 are similarly described in FIG. 6.

Figure 9:
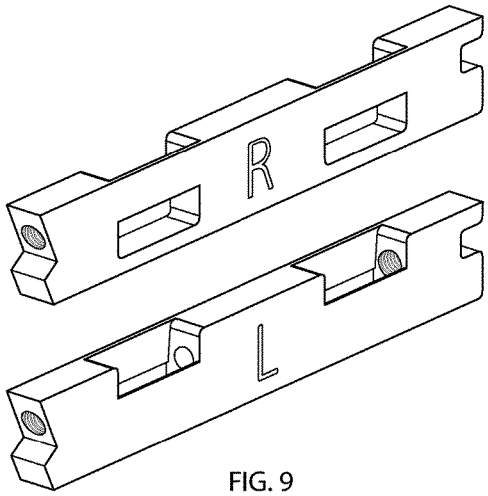
FIG. 9 is an axonometric view of a set of adapters with two adapters according to selected embodiments of the current disclosure.

FIG. 9 is an axonometric view of a set of adapters with two adapters according to selected embodiments of the current disclosure. This set of adapters includes a right adapter and a left adapter.

Figure 10:
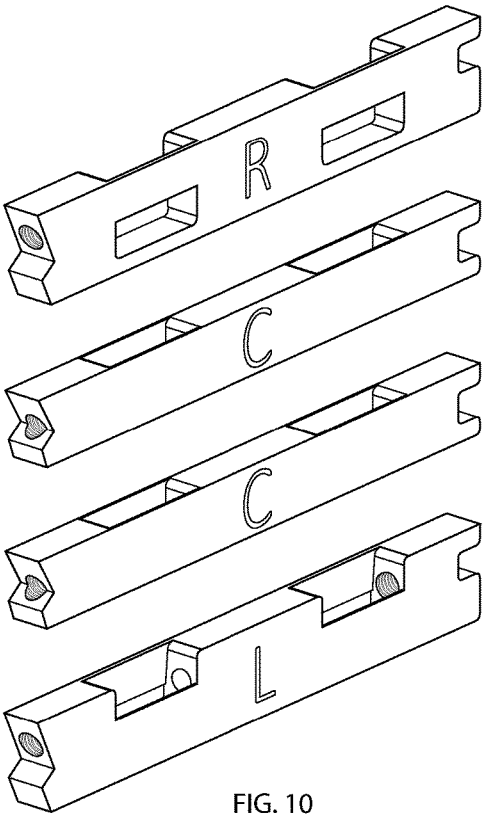
FIG. 10 is an axonometric view of a set of adapters with four adapters according to selected embodiments of the current disclosure.

FIG. 10 is an axonometric view of a set of adapters with four adapters according to selected embodiments of the current disclosure. This set of adapters includes a right adapter, a left adapter, and two center adapters.

Figure 11:
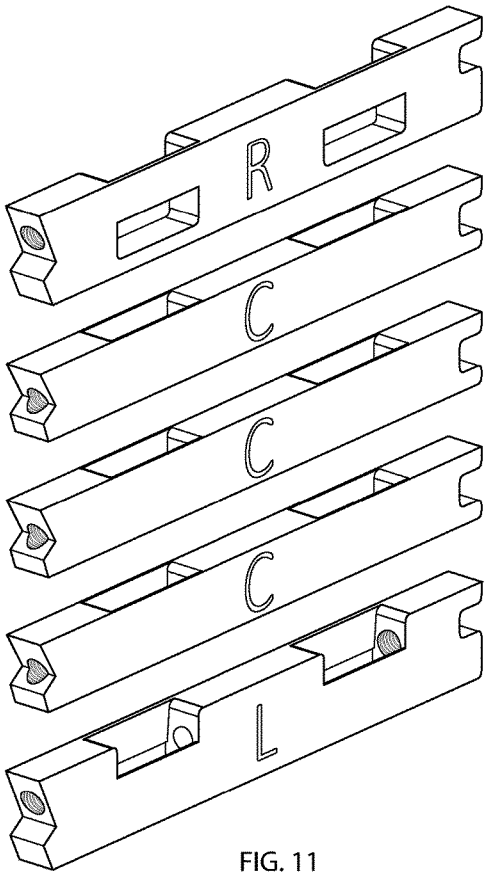
FIG. 11 is an axonometric view of a set of adapters with five adapters according to selected embodiments of the current disclosure.

FIG. 11 is an axonometric view of a set of adapters with five adapters according to selected embodiments of the current disclosure. This set of adapters includes a right adapter, a left adapter, and three center adapters.

The advantages of the present invention include, without limitation, the ability to securely fasten a two-tabbed removable fin to a single-tab fin box, which would otherwise not be possible.

In broad embodiment, the present invention is a removable surfboard fin adapter that allows removable fins and fin boxes from different manufacturers to be compatible.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

REFERENCE NUMBERS

1. Underside of surfboard
2. Surfboard
3. Right fin box
4. Center fin box
5. Left fin box
6. Right fin
7. Center fin
8. Left fin
9. Two-tabbed fin
10. Tabs
11. Angled vertical slot
12. Set screws
13. Threaded lateral holes
14. Single-tab surfboard fin tab
15. Single-tabbed fin box
16. Retention member of single-tabbed fin box
17. Rear notch for retention by single-tabbed fin box
18. Threaded hole for of single-tabbed fin box
19. Front notch for retention by single-tabbed fin box
20. Invention, generally referenced, base unit
21. Pullout hole
22. Right fin angle of angled vertical slot
23. Left fin angle of angled vertical slot
24. Right fin adapter
25. Center fin adapter
26. Right fin angled slot
27. Center fin vertical slot (not angled)
28. Left fin adapter
29. Spacer
30. Adapter side wall cut-outs
31. Other embodiment of invention
32. Folded tab with stepped vertical slot

We claim:

1. An adapter system for allowing a two-tabbed fin to be secured to a single-tabbed fin box, comprising a base unit, a two-tabbed fin, and a single-tabbed fin box, where the base unit is capable of fitting into the single-tabbed fin box, where the base unit comprises a front section, a back section, a bottom section, a top section, and two side sections, where the base unit additionally comprises two vertical slots, a front slot and a back slot, separated by a spacer, with each slot comprising two end sections, a bottom section, a back section and a front section, where the two end sections, the bottom section, the back section and the front section create a trapezoidal cavity in the base, where each of two trapezoidal cavities is capable of receiving a tab from the two-tabbed fin, and the spacer is slightly smaller than a space between two tabs from the two-tabbed fin, where the back section and the front section of each of the two vertical slots are set at a cant angle, where the cant angle projects a fin at an angle other than 90 degrees vertically from the top surface of the single-tabbed fin box, where the front section of the base comprises a front notch, where the front notch is located on the front section of the base, where the front notch has three angled faces, a first angled face that recedes back in a backwards direction from the top section of the base, a second angled face and protrudes in a forward direction, and a third angled face that recedes back in a backwards direction, where the first angled face is connected to the top section of the base and the second angled face, and the second angled face is connected to the first angled face and the third angled face, and the third angled face is connected to the second angled face and the bottom section of the base, and where the angle of the second angled face is 90 perpendicular to the angle of a threaded hole for single-tabbed fin box of the single-tabbed fin box, such that by screwing a fin box screw into the threaded hole for single-tabbed fin box of a single-tabbed fin box, a front end of the fin box screw can secure the second angled face and retain the base in the single-tabbed fin box, where the front section additionally comprises a lateral hole, where the lateral hole is threaded to receive a set screw, where the lateral hole extends from the front section to the front slot, such that once a tab from the two-tabbed fin is inserted into the front slot, the tab can be secured by tightening the set screw such that it presses against the tab, where the rear section of the base comprises a rear notch, where the rear notch extends from approximately ¼ the distance from the top section of the base to the bottom section of the base to ½ the distance from the top section of the base to the bottom section of the base, such that the rear notch mates with a retention member of the single-tabbed fin box, where the rear notch additionally comprises a lateral hole, where the lateral hole extends from the rear notch to the back slot, such that once a tab from the two-tabbed fin is inserted into the back slot, the tab can be secured by tightening the set screw such that it presses against the tab, where, when the two-tabbed fin is inserted in the base, the set screw in the front section and the set screw in the notch can be tightened to secure the two-tabbed fin into the vertical slots, and then the base can be inserted into the single-tabbed fin box, and the rear notch is slid around the retention member of the single-tabbed fin box, and the base is then pushed to a bottom of the single-tabbed fin box, and a fin box screw is inserted into a threaded hole of the single-tabbed fin box, where the fin box screw, when tightened, secures the second angled surface of the front section of the base unit to the single-tabbed fin box, thereby securing the two-tabbed fin in a single-tabbed fin box, where at least one of the side sections of the base has one or more cut-outs, where the one or more cut-outs comprises a rectangular hole in the at least one side section of the base.

2. An adapter for allowing a two-tabbed fin to be secured to a single-tabbed fin box, comprising a base unit capable of fitting into a single-tabbed fin box, where the base unit comprises a front section, a back section, a bottom section, a top section, and two side sections, where the base unit additionally comprises two vertical slots, a front slot and a back slot, separated by a spacer, with each slot comprising two end sections, a back section and a front section, where the two end sections, the back section and the front section create a rectangular hole in the base, where each of two rectangular holes is capable of receiving a tab from a two-tabbed fin where the front section of the base additionally comprises a front notch, where the front notch has three angled faces, a first angled face that recedes back in a backwards direction from the top section of the base, a second angled face and protrudes in a forward direction, and a third angled face that recedes back in a backwards direction, where the first angled face is connected to the top section of the base and the second angled face, and the second angled face is connected to the first angled face and the third angled face, and the third angled face is connected to the second angled face and the bottom section of the base, where the front section additionally comprises a lateral hole, where the lateral hole is threaded to receive a set screw, where the lateral hole extends from the front notch of the front section to the front slot.

3. The adapter of claim 2, where the two vertical slots additionally comprise a bottom section, such that the two end sections, the bottom section, the back section, and the front section form a cavity with a bottom, and where the back section and the front section of each of the two vertical slots are set at a cant angle, where the cant angle projects a fin at an angle other than 90 degrees vertically from the top section of the base unit.

4. The adapter of claim 3, where the cant angle is between 87 degrees and 90 degrees vertically from the top section of the base.

5. The adapter of claim 3, where the cant angle is between 87 and 75 degrees vertically from the top section of the base unit.

6. The adapter of claim 3, where the cant angle is greater than 75 degrees vertically from the top section of the base unit.

7. The adapter of claim 2, where the rear section of the base additionally comprises a rear notch, where the rear notch extends from approximately ¼ the distance from the top section of the base to the bottom section of the base to ½ the distance from the top section of the base to the bottom section of the base.

8. The adapter of claim 7, where the rear notch additionally comprises a lateral hole, where the lateral hole extends from the rear notch to the back slot.

9. The adapter of claim 2, where at least one of the side sections of the base has one or more cut-outs, where the one or more cut-outs comprises a rectangular hole in the at least one of the side sections of the base unit.

10. The adapter of claim 2, where the adapter is designed to fit a right side fin into a right side fin box.

11. The adapter of claim 2, where the adapter is designed to fit a left side fin into a left side fin box.

12. The adapter of claim 2, where, the adapter is designed to fit a center fin into a center fin box, where the two vertical slots each additionally comprise a bottom section, where the two end sections, the bottom section, the back section and the front section create a trapezoidal cavity in the base, where each of the trapezoidal cavities is capable of receiving a tab from a two-tabbed fin.

13. A set of adapter systems for allowing two or more two-tabbed fins to be secured to two or more single-tabbed fin boxes, where each adapter system comprises a base unit, a two-tabbed fin, and a single-tabbed fin box, where the base unit capable of fitting into the single-tabbed fin box, where the base unit comprises a front section, a back section, a bottom section, a top section, and two side sections, where the base unit additionally comprises two vertical slots, a front slot and a back slot, separated by a spacer, with each slot comprising two end sections, a back section and a front section, where the two end sections, the back section and the front section create a rectangular hole in the base, where each of two rectangular holes is capable of receiving a tab from the two-tabbed fin, and the spacer is slightly smaller than a space between two tabs from the two-tabbed fin, where the front section of the base additionally comprises a front notch, where the front notch has three angled faces, a first angled face that recedes back in a backwards direction from the top section of the base, a second angled face and protrudes in a forward direction, and a third angled face that recedes back in a backwards direction, where the first angled face is connected to the top section of the base and the second angled face, and the second angled face is connected to the first angled face and the third angled face, and the third angled face is connected to the second angled face and the bottom section of the base, and where the angle of the second angled face is 90 perpendicular to the angle of a threaded hole for single-tabbed fin box of the single-tabbed fin box, such that by screwing a fin box screw into the threaded hole for the single-tabbed fin box of a single-tabbed fin box, a front end of the fin box screw can secure the second angled face and retain the base in the single-tabbed fin box, where the front section additionally comprises a lateral hole, where the lateral hole is threaded to receive a set screw, where the lateral hole extends from the front notch to the front slot, such that a tab from a two-tabbed fin that is inserted into the front slot is secured by tightening the set screw until it presses against the tab, where the rear section of the base additionally comprises a rear notch, where the rear notch extends from approximately ¼ the distance from the top section of the base to the bottom section of the base to ½ the distance from the top section of the base to the bottom section of the base, such that the rear notch mates with a retention member of the single-tabbed fin box, where the rear notch additionally comprises a lateral hole, where the lateral hole extends from the rear notch to the back slot, such that a tab from a two-tabbed fin that is inserted into the back slot is secured by tightening the set screw until it presses against the tab.

14. The set of adapter systems of claim 13, where each vertical slot of each base unit further comprises a bottom section, where the two end sections, the bottom section, the back section and the front section create a trapezoidal cavity in the base, where each of the trapezoidal cavities is capable of receiving a tab from a two-tabbed surfboard fin, and the spacer is slightly smaller than a space between two tabs from a two-tabbed surfboard fin.

15. The set of adapter systems of claim 13, where the back section and the front section of each of the two vertical slots of each base unit are set at a cant angle, where the cant angle projects a fin at an angle other than 90 degrees vertically from the top section of the base unit.

16. The set of adapter systems of claim 15, where the cant angle is between 87 degrees and 70 degrees vertically from the top section of the base unit.

17. The set of adapter systems of claim 15, where the set of adapter systems comprises a right side adapter system, a left side adapter system, and a center adapter system, where the center adapter is designed to fit a center fin into a center fin box, the left adapter is designed to fit a left fin into a left fin box, and the right adapter is designed to fit a right fin into a right fin box of a surfboard known in the surfing industry as a tri-fin thruster surfboard.

18. The set of adapter systems of claim 17, where the cant angle is between 87 degrees and 70 degrees vertically from the top section of the base unit.

19. The set of adapter systems of claim 13, where at least one of the side sections of the base has one or more cut-outs, where the one or more cut-outs comprises a rectangular hole in the at least one of the side sections of the base unit.

20. The set of adapter systems of claim 13, where the set of adapter systems comprises a right side adapter system, a left side adapter system, and two center fin adapter systems, designed to fit the fin boxes of a surfboard known in the surfing industry as a quad fin surfboard, where each of the right side adapter and the left side adapter systems additionally comprise a bottom section of each vertical slot of its base unit, such that the two end sections, the bottom section, the back section, and the front section form a cavity with a bottom, and where the back section and the front section of each of the two vertical slots are set at a cant angle, where the cant angle projects a fin at an angle other than 90 degrees vertically from the top section of the base unit.

21. The set of adapter systems of claim 20, where the cant angle is between 87 degrees and 70 degrees vertically from the top section of the base unit.

22. The set of adapter systems of claim 13, where the set of adapter systems comprises two right side adapter systems and two left side adapter systems, designed to fit the fin boxes of a surfboard known in the surfing industry as a quad fin surfboard, where each of the four adapter systems additionally comprise a bottom section of each vertical slot of its base unit, such that the two end sections, the bottom section, the back section, and the front section form a cavity with a bottom, and where the back section and the front section of each of the two vertical slots are set at a cant angle, where the cant angle projects a fin at an angle other than 90 degrees vertically from the top section of the base unit.

23. The set of adapter systems of claim 22, where the cant angle is between 87 degrees and 70 degrees vertically from the top section of the base unit.

24. The set of adapter systems of claim 13, where the set of adapter systems comprises a right side adapter systems, a left side adapter system, and three center fin adapter systems, designed to fit the fin boxes of a surfboard known in the surfing industry as a 5-fin surfboard, where each of the right side adapter and the left side adapter systems additionally comprise a bottom section of each vertical slot of its base unit, such that the two end sections, the bottom section, the back section, and the front section form a cavity with a bottom, and where the back section and the front section of each of the two vertical slots are set at a cant angle, where the cant angle projects a fin at an angle other than 90 degrees vertically from the top section of the base unit.

25. The set of adapter systems of claim 24, where the cant angle is between 87 degrees and 70 degrees vertically from the top section of the base unit.

26. The set of adapter systems of claim 13, where the set of adapter systems comprises two right side adapter systems, two left side adapter and a center adapter system, designed to fit five fin boxes of a surfboard known in the surfing industry as a 5-fin surfboard, where each of the right side adapter and left side adapter systems additionally comprise a bottom section of each vertical slot of its base unit, such that the two end sections, the bottom section, the back section, and the front section form a cavity with a bottom, and where the back section and the front section of each of the two vertical slots are set at a cant angle, where the cant angle projects a fin at an angle other than 90 degrees vertically from the top section of the base unit.

27. The set of adapter systems of claim 26, where the cant angle is between 87 degrees and 70 degrees vertically from the top section of the base unit.

* * * * *